United States Patent [19]

Hamilton

[11] 4,271,636

[45] Jun. 9, 1981

[54] LENS GENERATING APPARATUS

[75] Inventor: W. Duane Hamilton, Middletown, R.I.

[73] Assignee: American Optical Corporation, Southbridge, Mass.

[21] Appl. No.: 77,681

[22] Filed: Sep. 21, 1979

[51] Int. Cl.[3] ..... B24B 13/00

[52] U.S. Cl. ..... 51/33 W

[58] Field of Search ..... 51/33 R, 33 W, 55, 124 L, 51/284 R; 409/162

[56] References Cited

U.S. PATENT DOCUMENTS

| | | | |
|---|---|---|---|
| 1,325,789 | 12/1919 | Johnsson | 51/33 W |
| 2,392,478 | 1/1946 | Holman | 51/33 W |
| 2,548,418 | 4/1951 | Bernheim | 51/55 |
| 2,633,675 | 4/1953 | Ellis | 51/33 R |
| 2,724,218 | 11/1955 | Dillon | 51/55 |
| 3,117,396 | 1/1964 | Dalton | 51/284 |
| 3,492,764 | 2/1970 | Dalton | 51/284 |
| 3,624,969 | 12/1971 | Dalton | 51/131.5 |
| 4,018,206 | 4/1977 | Highberg | 51/33 R X |

*Primary Examiner*—Gary L. Smith

*Attorney, Agent, or Firm*—Jeremiah J. Duggan; Alan H. Spencer

[57] ABSTRACT

Generating lens surfaces to true toric or spherical shapes with lens surfacing machinery employing a dual pivoting system and fixed radius cutter. Lenses are fed across the cutter along a first circular path developing the spherical component of a toric surface while the cutter is simultaneously swept orthogonally across the lens along a second circular path which develops the cylindrical component of the toric surface. Various combinations of spherical and cylindrical curvatures are produced by adjustment of radii of first and second circular paths.

10 Claims, 3 Drawing Figures

LENS GENERATING APPARATUS

BACKGROUND OF THE INVENTION

1. Field of the Invention:

This invention relates to lens surfacing apparatus and has particular reference to improvements in toric surface generators.

2. Discussion of the Prior Art:

A toric surface is a surface of compound curvature frequently used ophthalmically for the correction of astigmatism. By compound curvature it is meant that the radius of curvature in one meridian is different than the radius of curvature in a second orthogonal meridian. These curvatures are commonly referred to as the spherical and cylindrical components of the tore, the cylindrical component usually being of greatest power (i.e. shortest radius of curvature).

Because of the large commercial and practical importance of toric surfaces, a number of techniques have developed for their production. An early technique involved the use of preformed tools each having the shape of a particular toric curve desired on a lens, i.e. a mirror image of the desired lens surface shape. This preformed tool was abraded against the lens surface in conjunction with abrasive slurries in such a way that gradually the lens assumed the shape of the tool. Thus, reasonably accurate toric surfaces were produced. Because of rapid tool wear, however, and the vast inventory of preformed tools needed to satisfy the hundreds of combinations of the two meridianal radii of curvature encountered in the field, preformed tools have been largely replaced by a rotating cupped or ring tool.

The cupped or ring tool typically has an annular working edge which abrades the workpiece, be it glass or plastic. A toric surface is achieved by having the radius through which the ring tool is swung be substantially the same as one of the desired radii of lens surface curvatures. The second radius of curvature in a meridian at right angles to the first is achieved by a tilt of the ring tool so that the profile of the tool assumes approximately the curvature of the second radius. The universal nature of being able to modify independently both the radius of swing and the angle of tool tilt eliminates the need for large tool inventory. Nevertheless, in the process of using the angle of tilt to modify one effective tool cutting radius, an elliptical error is introduced so that the lens surface formed is not a true toroid. This elliptical error is in most cases significant. It requires subsequent surface grinding to eliminate.

A number of attempts have been made to overcome the problems associated with elliptical error. In one case, the elliptical error was minimized by moving the tool relative to the lens in a series of complex motions which necessitated correspondingly complex and expensive machinery not well suited for use in custom laboratory operations. More recent attempts used a grinding tool which was swung through one of the desired radii of curvature with its own radius of curvature being that of the second radius desired on the lens. This, however, necessitates a separate tool for each second radius of curvature and hence, still requires costly tool inventory. Such a need for large tool inventory can, however, be reduced by still using the aforementioned cupped or ring tool which is swung through one radius with the orthogonal tool profile assuming the curve along a second meridian which is at the same time modified with an oscillating motion of the lens relative to the tool. Although theorectically capable of producing desired surface curvatures, this scheme is cumbersome and difficult to implement and lacks the rigidity needed for optimum surfacing.

Examples of the above toric generating schemes and apparatuses can be found in U.S. Pat. Nos. 2,548,418; 2,633,675; 2,724,218; 3,117,396; 3,492,764 and 3,624,969.

With a view to overcoming the above and other shortcomings of the prior art, it is an object of this invention to simplify the manufacture of true toric or spherical surfaces and more particularly to avoid elliptical error in toric lens surfaces intended for the correction of astigmatism.

More specifically, an object of the invention is to accomplish the foregoing with surface generating apparatus capable of producing numerous combinations of spherical and cylindrical lens curvatures using a single fixed radius cutter.

Still another object is to provide for toric and spherical lens surfacing with minimal equipment complication and without need for special operating skills.

Other objects and advantages of the invention will become apparent from the following description.

SUMMARY OF THE INVENTION

The foregoing objects and their corollaries are accomplished with a dual pivoting axis system using a fixed radius cutter. The lens is fed across the cutter along a first circular path developing the spherical component of a toric surface to be cut while the cutter is simultaneously swept orthogonally across the lens along a second circular path which develops the cylindrical component of the toric surface. Various combinations of spherical and cylindrical curvatures are accomplished by adjustment of radii of first and second circular paths.

Details of the invention will become more readily apparent from the following description when taken in conjunction with the accompanying drawings.

IN THE DRAWINGS

DESCRIPTION OF THE PREFERRED EMBODIMENTS

Figure 1:
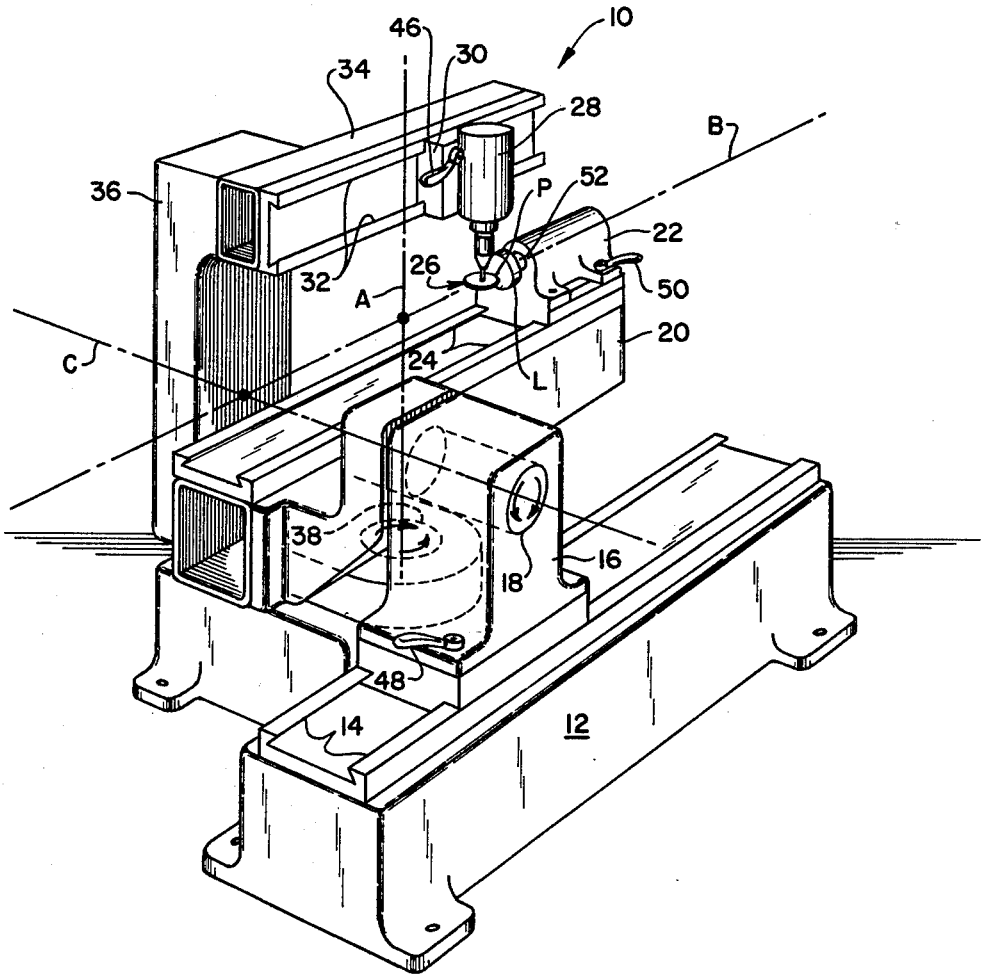
FIG. 1 is an illustration, in perspective, of a preferred embodiment of the invention.

Referring to the drawings, machine 10 has base 12 with ways 14 and slide 16. Slide 16, which is adapted to traverse ways 14, carries pivot 18 which supports work carrying arm 20. Tailstock 22 carrying workpiece lens L is slidable along ways 24 of arm 20 for adjustment of the working position of lens L therealong.

Fixed radius cutter 26, driven by motor 28, is mounted upon slide 30 which is adjustable along ways 32 of cutter carrying arm 34. Upright 36 pivoted on bearing 38 in base 12 carries arm 34 in such manner that swinging of upright 36 on bearing 38 will sweep cutter 26 arcuately across lens L about axis A.

The distance from axis A to the effective cutting point P of cutter 26 will establish the shorter or cylindrical radius of toric curvature to be produced upon lens L and the distance from axis C to the same effective cutting point P of cutter 26 will establish the longer or spherical radius of the tore. The effective cutting point P of cutter 26 is considered as being a point on axis B at a distance from the axis of motor 28 which is equal to the cutter radius.

Figure 2:
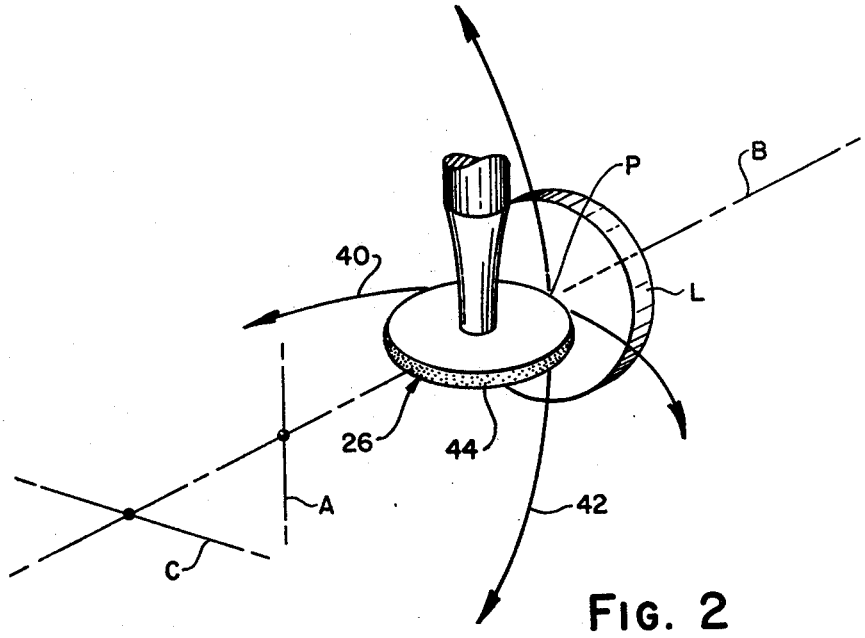
FIG. 2 is a schematic illustration of performance of a toric lens generating operation using the apparatus of FIG. 1.

In setting machine 10 for the cutting of a toric surface on lens L of predetermined cylindrical and spherical curvatures 40 and 42 respectively (FIG. 2), slide 30 is adjusted along arm 34 to the point where point P of cutting edge 44 (FIGS. 1 and 2) of cutter 26 is at a distance along axis B from vertical axis A which is equal to the radius of curvature desired of the cylindrical component of the toric surface to be generated. Slide 30 is then fixed in ways 32 with a conventional gib lock 46 or other means commonly used on machine slides for such purpose.

With lens L kept clear of cutter 26, slide 16 is adjusted along ways 14 to the point where the distance from working contact P of edge 44 of cutter 26 to axis C (FIG. 2) equals the radius of the spherical component of the toric surface to be produced on lens L. Gib lock 48 or its equivalent is then tightened to fix the setting of slide 16.

Tailstock 22 is adjusted along axis B by means of ways 24 a distance toward edge 44 of cutter 26 according to the depth of cut desired upon lens L and gib lock 50 or its equivalent is tightened to fix the tailstock in place.

With the above settings and motor 28 energized, the toric surface curvature is produced by simultaneously or successionally swinging cutter 26 about axis A while tailstock 22 (i.e. lens L) is swung about axis C. Single or multiple passes of tool and lens L in either or both the cylindrical and spherical directions 40 and 42 may be made along with additional adjustments of tailstock 22 for depth of cut.

While not shown in the present drawings, it should be apparent that tailstock 22 and slides 16, 30 may be motor driven and that the swinging of cutter 26 and lens L about axes A and C respectively may be performed by motor drive or manually with lever or crank means, also not shown. Crank, lever and/or motor drive mechanisms suitable for the above purpose are well known in the art and exemplified in the earlier listed examples of patented prior art devices.

It is also pointed out that the mounting of lens L in tailstock 22 is accomplished conventionally, e.g. by attachment of the lens to a lens block which, in turn, is fitted to a tapered receiving arbor 52 or its equivalent. Various useful lens mounting schemes are also illustrated in the above exemplification of prior art.

Use of the expression "lens" herein is intended to include the article in any of its various forms including cast, molded or pressed blanks of plastic or glass completely unfinished or semi-finished, i.e. having one side only finished or partly finished by casting or grinding with or without final polishing.

Figure 3:
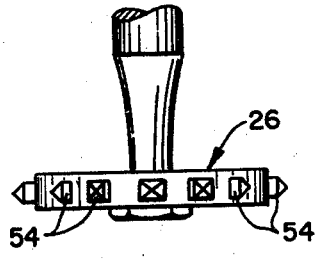
FIG. 3 is an elevational view of a modified form of lens cutter which may be used in the practice of the invention.

Cutter 26 may be provided with a continuous cutting edge 44 of abrasive material such as silicon carbide or the usual diamond charged matrix (FIG. 2) or fitted with cutting points 54 as in FIG. 3. Points 54 may be preselected or shaped to best suit the material of the lens being cut.

From the foregoing it can be seen that objectives of the invention are accomplished with the action of a dual pivoting system which produces true spherical and cylindrical curvatures on a lens with a single fixed radius cutter, i.e. the selected cutter is universal to the production of all combinations of curvatures encountered in the art.

With the distances along axis B from working contact P to axis A and from point P to axis C set to be equal, the above described cutting action will produce a spherical surface on lens L. In all cases, prior art elliptical error problems are eliminated.

Those skilled in the art will readily appreciate that various modifications and adaptations of the precise forms of the invention described above may be made to suit particular requirements. Accordingly, it is intended that all modifications which incorporate the novel concept disclosed are to be construed as coming within the scope of the appended claims or the range of equivalency to which they are entitled in view of the prior art.

I claim:

1. Lens generating apparatus comprising a machine base;

a work carrying arm supported by said base, said work carrying arm being pivotal relative to said base about a first axis for swinging a workpiece carried thereby about said first axis;

a cutter carrying arm also supported by said base, said cutter carrying arm being pivotal relative to said base about a second axis directed orthogonally to the direction of said first axis for swinging a cutter carried thereby about said second axis;

means for supporting a workpiece on said work carrying arm and means for supporting a fixed radius axially rotatable cutter on said cutter carrying arm, said cutter having a thin edge disposed in a plane parallel to the direction of said first axis and being rotatable about an axis parallel to the direction of said second axis;

means for selectively bringing a supported workpiece and said thin edge of said cutter to a point of working contact with each other; and means for adjusting distances from said point of working contact to respective first and second axes according to corresponding curvatures desired to be generated on said workpiece whereby swinging of said work carrying and cutter carrying arms about respective first and second axes with simultaneous rotation of said cutter about its axis will effect a bicurve surface generation of said workpiece; said generation being toric when said distance from said working contact to first and second axes differ and spherical when said distances are alike.

2. Apparatus according to claim 1 wherein said means for supporting said workpiece includes a machine tailstock and said means for supporting said cutter includes a drive motor.

3. Apparatus according to claim 2 wherein said means for bringing said workpiece and cutter to said point of working contact includes first ways on said work carrying arm along which said tailstock may be adjusted toward said cutter.

4. Apparatus according to claim 1 wherein support for said pivotal work carrying arm includes a slide and second ways on said base, said slide being adjustable along said second ways for adjusting distance between a cutter carried by said cutter carrying arm and said first axis about which a workpiece carried by said work supporting arm may be swung.

5. Apparatus according to claim 2 wherein said cutter carrying arm includes a slide upon which said drive motor is mounted and third ways for adjusting distance between a cutter supported by said drive motor and said second axis about which said cutter may be swung.

6. Apparatus according to claim 1 wherein said first and second axes intersect a third axis extending through said point of working contact.

7. Apparatus according to claim 1 wherein said cutter has a circular abrading edge of fixed radius.

8. Apparatus according to claim 7 wherein said abrading edge of said cutter is substantially continuous and formed of embedded abrasive particle means.

9. Apparatus according to claim 8 wherein said abrasive particle means are diamonds.

10. Apparatus according to claim 7 wherein said abrading edge comprises a succession of peripherally spaced cutting points.

* * * * *